US008408126B2

(12) United States Patent
Faber

(10) Patent No.: US 8,408,126 B2
(45) Date of Patent: Apr. 2, 2013

(54) SELF-INKING HAND STAMP

(75) Inventor: Ernst Faber, Wels (AT)

(73) Assignee: Colop Stempelerzeugung Skopek Gesellschaft m.b.H. & Co. KG, Wels (AT)

( * ) Notice: Subject to any disclaimer, the term of this patent is extended or adjusted under 35 U.S.C. 154(b) by 358 days.

(21) Appl. No.: 12/798,630

(22) Filed: Apr. 8, 2010

(65) Prior Publication Data

US 2010/0263561 A1 Oct. 21, 2010

(30) Foreign Application Priority Data

Apr. 17, 2009 (AT) ..... 598/2009

(51) Int. Cl.
*B41K 1/42* (2006.01)
*B41J 27/00* (2006.01)

(52) U.S. Cl. ..... 101/334; 101/105

(58) Field of Classification Search ..... 101/103, 101/104, 333, 334, 405
See application file for complete search history.

(56) References Cited

U.S. PATENT DOCUMENTS

| | | | | |
|---|---|---|---|---|
| 232,349 | A * | 9/1880 | Hill | 101/334 |
| 454,499 | A | 6/1891 | Ryer | |
| 1,834,629 | A | 12/1931 | McArdle | |
| 2,252,649 | A * | 8/1941 | Smallman | 101/333 |
| 5,850,787 | A | 12/1998 | Pichler | |
| 7,464,643 | B2 | 12/2008 | Pointl | |
| D618,274 | S * | 6/2010 | Faber | D18/15 |
| 7,761,959 | B2 * | 7/2010 | Shih | 16/436 |
| 2008/0000369 | A1 | 1/2008 | Ameshofer | |

FOREIGN PATENT DOCUMENTS

| | | |
|---|---|---|
| AT | 380 836 | 7/1986 |
| AT | 001 185 | 12/1996 |
| AT | 001 659 | 9/1997 |
| AT | 501 318 | 8/2006 |
| DE | 2 006 182 | 8/1971 |
| DE | 295 21 420 | 3/1997 |
| GB | 1 323 049 | 7/1973 |
| GB | 2 309 420 | 7/1997 |
| WO | WO 2005/037565 | 4/2005 |

OTHER PUBLICATIONS

Austrian Office Action dated Feb. 22, 2010 with an English translation of the relevant parts.

* cited by examiner

*Primary Examiner* — Judy Nguyen
*Assistant Examiner* — Leo T Hinze
(74) *Attorney, Agent, or Firm* — Collard & Roe, P.C.

(57) ABSTRACT

A self-inking hand stamp includes a frame made of metal and having two side walls which are interconnected by an upper cover wall, and an actuating bow made of metal, which in use is downwardly movable relative to the frame against a spring force. The actuating bow has two legs protruding from an upper web, which are displaceable along the side walls of the frame and coupled with a type unit arranged to be upwardly and downwardly displaceable and turnable within the frame. Two parallel guide webs laterally abutting on the respective bow leg, which is rectangular in elevation and narrower as compared to the frame side wall, are latchingly attached to the outer side of each side wall of the frame in the upper region thereof.

10 Claims, 8 Drawing Sheets

SELF-INKING HAND STAMP

CROSS REFERENCE TO RELATED APPLICATIONS

Applicant claims priority under 35 U.S.C. §119 of Austrian Application No. A 598/2009 filed Apr. 17, 2009.

FIELD OF THE INVENTION

The invention relates to a self-inking hand stamp comprising a frame made of metal and having two side walls which are interconnected by an upper cover wall, and further comprising an actuating bow made of metal, which in use is downwardly movable relative to the frame against a spring force, said actuating bow having two legs protruding from an upper web, which are displaceable along the side walls of the frame and coupled with a type unit arranged to be upwardly and downwardly displaceable and turnable within the frame.

BACKGROUND OF THE INVENTION

Such so-called (full) metal self-inking hand stamps have been known for a long time, cf. U.S. Pat. No. 454,499 A, and have been appreciated for their robustness and long useful life. The frame, also called stamp housing, usually consists of a steel sheet part which, after having been cut out or punched out, is bent accordingly, cf. e.g. also AT 1 185 U1, FIG. 5. When actuating the hand stamp, i.e. when making a stamp imprint, the actuating bow is moved downwards along the frame that has been put onto a substrate, wherein the legs of the actuating bow, which is U-shaped in elevation, are displaced along the outer sides of the side walls of the frame. A tube attached on top of the cover plate of the frame allows for guiding and position-securing, which tube is telescopically insertable into a corresponding tube or the like receiving means in a handle on the actuating bow, the tube usually containing a helical compression spring, cf. e.g., also AT 380 836 B or AT 1 659 U1. An additional guiding of the legs of the actuating bow on the side walls of the frame is further obtained in that the bow legs are coupled with a turning axle or with axle stubs of the type unit, e.g. a simple stamp plate or a unit with belt types, the ends of this axle or of these axle stubs being guided in a slot guide in the side walls of the frame. However, neither this axle guide nor the telescopic tube are intended as the guide proper for the actuating bow on the frame, these components a priori much rather have other functions and, therefore, malfunctions to the point of canting or self-locking of the actuating bow on the housing of the hand stamp may very well occur.

For this reason, hood-shaped guiding parts of plastics material put on the frame have already been suggested in the past, cf. the afore-mentioned AT 1 185 U1 or also AT 1 659 U1, so as to guide the actuating bow on the metal frame by said hood-shaped guiding part. In this hood-shaped guiding part, also an insertion compartment for an ink pad holder has been provided above the metal frame. These hood-shaped guiding parts cause, however, substantial expenditures when producing and assembling the hand stamp. This is the more so for a steel/plastics composite design of frame and actuating bow, such as proposed in AT 501 318 B1, or also in DE 295 21 420 U1, e.g., where metal parts are received in fitting plastics parts.

On the other hand, a guide in the form of projecting side edges of the frame as disclosed in AT 380 836 B for guiding the respective leg of the actuating bow between these projecting side edges cannot be realized with a metal frame, but only with a plastic frame made, for instance, by injection molding. Such a plastic frame, however, does not have the sturdiness and endurance of a metal frame; it would, therefore, be desirable to enable an appropriate guidance of the actuating bows on the frame even in the event of a metal frame and metal actuating bows, i.e. with a "full-metal self-inking stamp", without considerably increasing the expenditures involved in the manufacture and assemblage of the hand stamp.

SUMMARY OF THE INVENTION

It is, thus, an object of the invention to provide a self-inking hand stamp as pointed out in the beginning, which allows for a simple, yet reliable guidance of the legs of a metal actuating bow on the side walls of a metal frame of a self-inking hand stamp.

According to an aspect of the invention, in a hand stamp of the initially defined kind, it is provided that two parallel guide webs laterally abut on the respective bow leg, which is rectangular in elevation and narrower as compared to the frame side wall, are latchingly attached to the outer side of each side wall of the frame in the upper region thereof.

In the present self-inking hand stamp, guide webs are thus fastened to the outer sides of the side walls of the frame in the upper region of the frame, wherein said guide webs are simply latched with the side walls of the frame. In doing so, two separate, ledge-shaped guide webs can be provided, which, for instance, are each attached by two superimposed latch projections to be inserted in latch openings provided in the side walls of the frame.

For a particularly simple mounting, a high degree of sturdiness and stability as well as, in particular, a smooth-running slide-guidance of the bow legs at a distance from the metal outer side of the side walls, it will, however, be of particular advantage, if the guide webs are formed on a generally platelet-shaped guide body latched to the respective frame side wall. In this case, it will be particularly beneficial, i.a., for a good positioning and positional fixation of the guide body, if the guide body comprises an upper, flange-like roof projection protruding from the side opposite the side of the guide webs and abutting on an upper transition region from the side wall to the upper cover wall of the frame.

Theoretically, hook-shaped latch projections might be bent out from the side walls of the frame, projecting into respective openings of the guide body in order to fix the guide body to the respective side wall. In terms of production engineering, it will, however, be more favorable if the guide body, on its side facing away from the guide webs, comprises latch projections, by the aid of which it is fixed in associated, simple latch openings of the frame side wall by snapping engagement.

The initially cited U.S. Pat. No. 454,499 A already shows an option for an insertion guide of an ink pad holder, wherein either lugs are punched out of the frame side wall and bent inwards or angle brackets are riveted to the side walls of the frame, on the inner side thereof. With the present hand stamp, the guide bodies provided according to the invention can now advantageously be additionally utilized inasmuch as they will simultaneously enable such an insertion guidance for an ink pad holder. In this context, it will be particularly advantageous if the respective guide body, on its side facing away from the guide webs, comprises support projections for an ink pad holder inserted or insertable in the upper region of the frame, which support projections project through openings provided in the frame side walls. For an efficient position securement, particularly against rotation of the guide bodies, it will be advantageous if separate support projections are provided above the latch projections. For a simple configuration, it will, however, also be beneficial if the latch projections simultaneously form the support projections.

With a view to the desired fixation by latching and the advantageous slide-guidance of the bow legs, it will be particularly advantageous, if the guide webs are made of plastics, such as POM, ABS or PE.

In order to provide for a sufficiently large guiding surface of the platelet-shaped guide body with regard to an adequate slide-guidance of the bow legs, without impeding the control function of the bow legs in respect to the downward movement and turning of the type unit, it will finally also be beneficial if the platelet-shaped guide body comprises a central, downwardly open recess for the passage of an end of a turn axle or axle stub of the type unit.

BRIEF DESCRIPTION OF THE DRAWINGS

The invention will be explained hereinafter in more detail by way of preferred exemplary embodiments to which it is, however, not to be restricted, and with reference to the drawings. Therein.

DETAILED DESCRIPTION OF PREFERRED EMBODIMENTS

Figure 1:
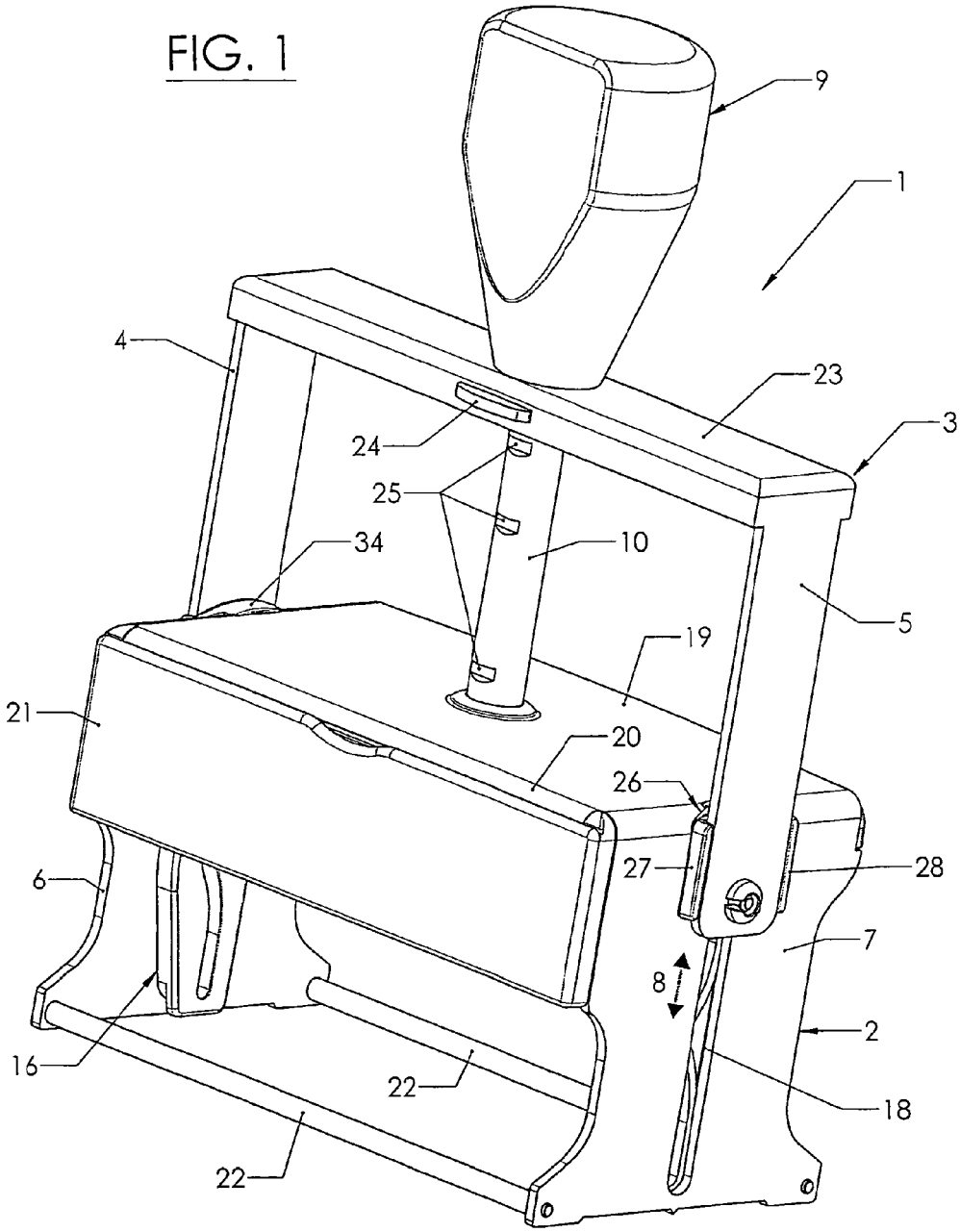
FIGS. 1 and 2 show a self-inking hand stamp according to the invention in axonometric views from the upper front side (FIG. 1), and from the lower front side (FIG. 2)
Figure 2:
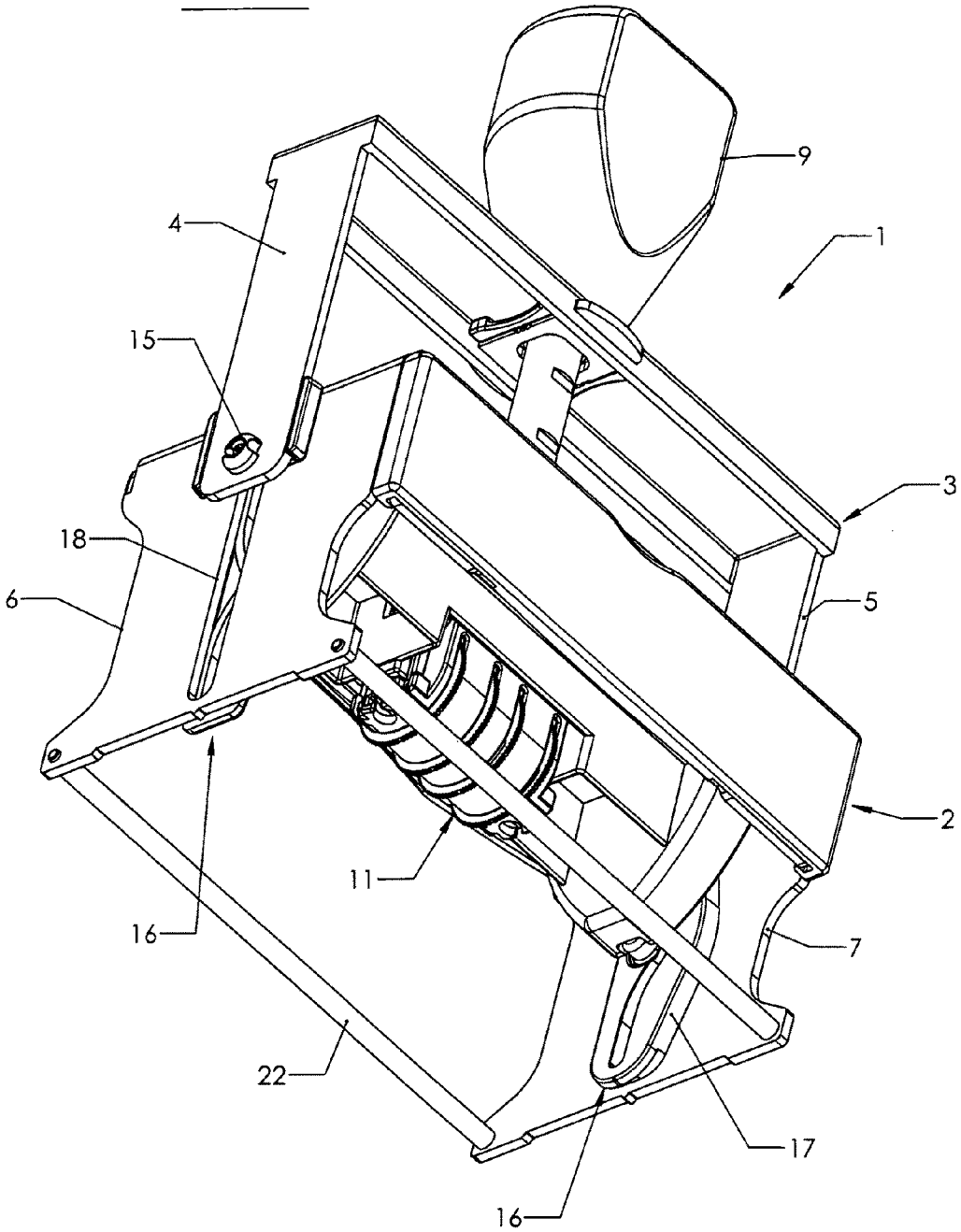

FIGS. 1 to 6 depict a hand stamp 1 with a self-inking mechanism, briefly called self-inking hand stamp 1, which includes a frame or housing 2 made of metal as well as an actuating bow 3, which is U-shaped in elevation and also made of metal. The actuating bow 3 has two legs 4, 5 which are guided on the outer sides of side walls 6, 7 of the metal frame 2 in the operating position so as to be vertically upwardly and downwardly movable, cf. also arrow 8 in FIG. 1. On the upper side of the actuating bow 3, a common handle 9 is attached which, on its inner side, is at least partially hollow so that, in a usual manner, a tube socket 10 can be accommodated in the interior of the handle 9, which tube socket is fixedly attached to the frame 2 on the upper side thereof and serves to receive a helical compression spring (not shown), as is known per se, which spring is supported on the upper side of the frame 2, on the one hand, and in the interior of the handle 9, on the other hand, so as to press the actuating bow 3 upwards according to the illustration of FIG. 1, into the illustrated rest position. The actuating bow 3 can be displaced downwards against this spring force when making a stamp imprint on a substrate (paper etc.) by means of a type unit 11 mounted within the frame 2 (cf. e.g. FIGS. 2 and 4, or 5, respectively). In doing so, during this downward movement of the actuating bow 3, the type unit 11 is downwardly displaced, and is additionally turned about its axle by 180°, as is known per se, so as to pivot the printing types, which in their upper rest position abut on an ink pad 12 of an ink pad holder 13 mounted in the upper region of the frame 2, by 180° and move them downwards so as to reach the imprinting position shown in FIG. 5. For this displacement movement, the legs 4, 5 of the actuating bow 3 are coupled with the ends of a turning axle 14 of the type unit 11 which is particularly visible in FIG. 5 (or to axle stubs laterally projecting from the type unit) via axle securing elements 15 known per se. Moreover, an also per se conventional, known turning mechanism 16 is provided for pivoting the type unit 11, e.g. by means of two control link elements 17 pivotably linked to the top of the inner sides of the side walls 6, 7 of the frame 2. For guiding the ends of the turning axle 14, vertical longitudinal slots 18 are provided in the frame side walls 6, 7.

Yet, the turning mechanism 16 may, of course, also be realized in another known form, such as shown in U.S. Pat. No. 454,499 A.

The metal frame 2 is formed of a punched or cut-out and appropriately bent steel sheet portion, the two side walls 6, 7 being integrally interconnected by an upper cover wall 19. On this cover wall 19, at the center thereof, the tube socket 10 for the helical compression spring is fixedly attached in a manner known per se, e.g. by riveting. Furthermore, as can be seen from FIGS. 1 and 2, on the broad front side of the hand stamp 1, there is a strip or web-shaped transverse wall 20 extending downwards from the cover wall 19, cf. also the sectional illustration in the corner region in FIG. 6, this transverse wall 20 extending from one side wall 6 to the other side wall 7 and, in the exemplary embodiment illustrated, being provided with a transparent, slipped-on plastics pocket 21 as an inspection window for accommodating a stamp-print sample sheet. On their lower sides, in the corner regions, the frame side walls 6, 7 are interconnected and, thus, are stabilized in their positions in a per se conventional manner by rods 22.

Figure 3:
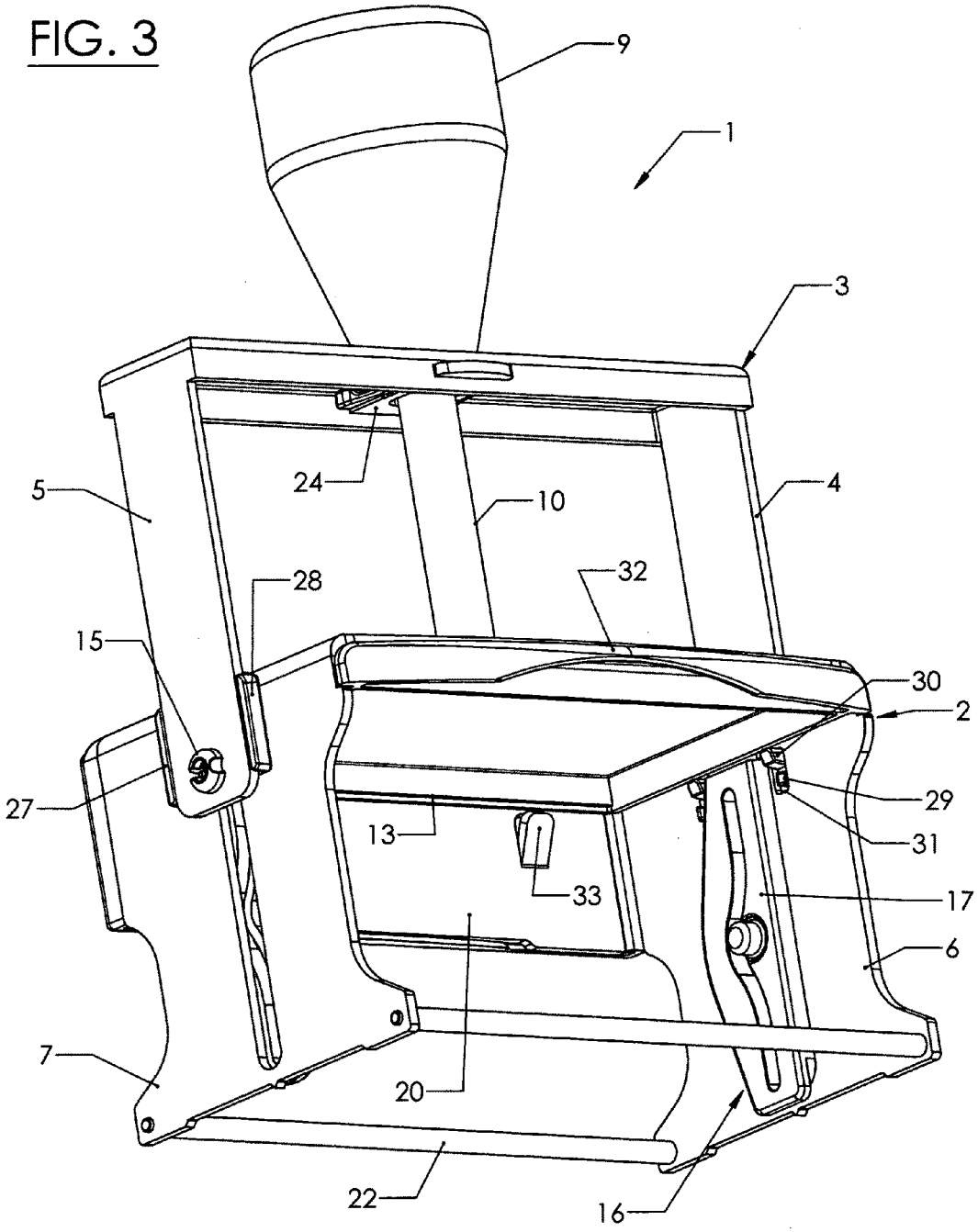
FIG. 3 shows an axonometric view of this hand stamp according to FIG. 1 from the rear side, with the type unit removed, so as to show the inner space of the frame of the hand stamp more clearly.

The two legs 4, 5 of the actuating bow 3 are also produced in one piece of steel sheet and interconnected by a web 23, which web moreover accommodates a slide 24 which can particularly be seen in FIGS. 1 and 3; by engagement of the latter in one of several depressions 25 on the tube socket 10, the actuating bow 3 can be fixed in a pre-determined position relative to the frame 2, e.g. so as to be able to readjust type belts in case of a type unit 11 comprising type belts indicating the date or the like, as shown, or, in particular, so as to be able to impregnate the ink pad 12 with ink.

As described so far, the present hand stamp 1 is of a per se known construction, and a more detailed description of the assembly and function of the hand stamp 1 can be omitted.

In the present hand stamp 1, a one-piece guide body 26 including guide webs 27, 28 for the respective leg 4 or 5, respectively, of the actuating bow 3 is externally attached to each frame side wall 6, 7 and fixed thereto by latching engagement. As can best be seen in FIGS. 7A, E and F, this guide body 26 is generally platelet-shaped and, in particular, shaped or injection-moulded of plastics such as, e.g., POM, ABS or also PE. On the one side, i.e. the outer side, of this platelet-shaped guide body 26, the above-mentioned guide webs 27, 28 for the respective leg 4 or 5, respectively, of the actuating bow 3 are provided. On the other side, i.e. the inner side, latch projections 29 for fastening to the respective side wall 6 or 7, respectively, on the one hand, and support projections 30 for the ink pad holder 13, on the other hand, are provided. As is particularly apparent from FIG. 7E, the latch projections 29 are hook-shaped, and by these hook-shaped latch projections 29, the guide body 26 is fixed by latching engagement in corresponding (latch) openings 31 (cf. FIGS. 3 and 5) of the side walls 6, 7 of the frame 2. From FIG. 3, an empty ink pad holder 13 is, moreover, apparent, which rests on the support projections 30 of the respective guide body 26 (cf. also FIG. 5) with its—in this operating position—lower rim of its two broadside walls, and, thus, can be pushed in or out similar to a drawer. For this purpose, it may be provided with a handle region 32, which can be seen in FIG. 3.

Figure 6:
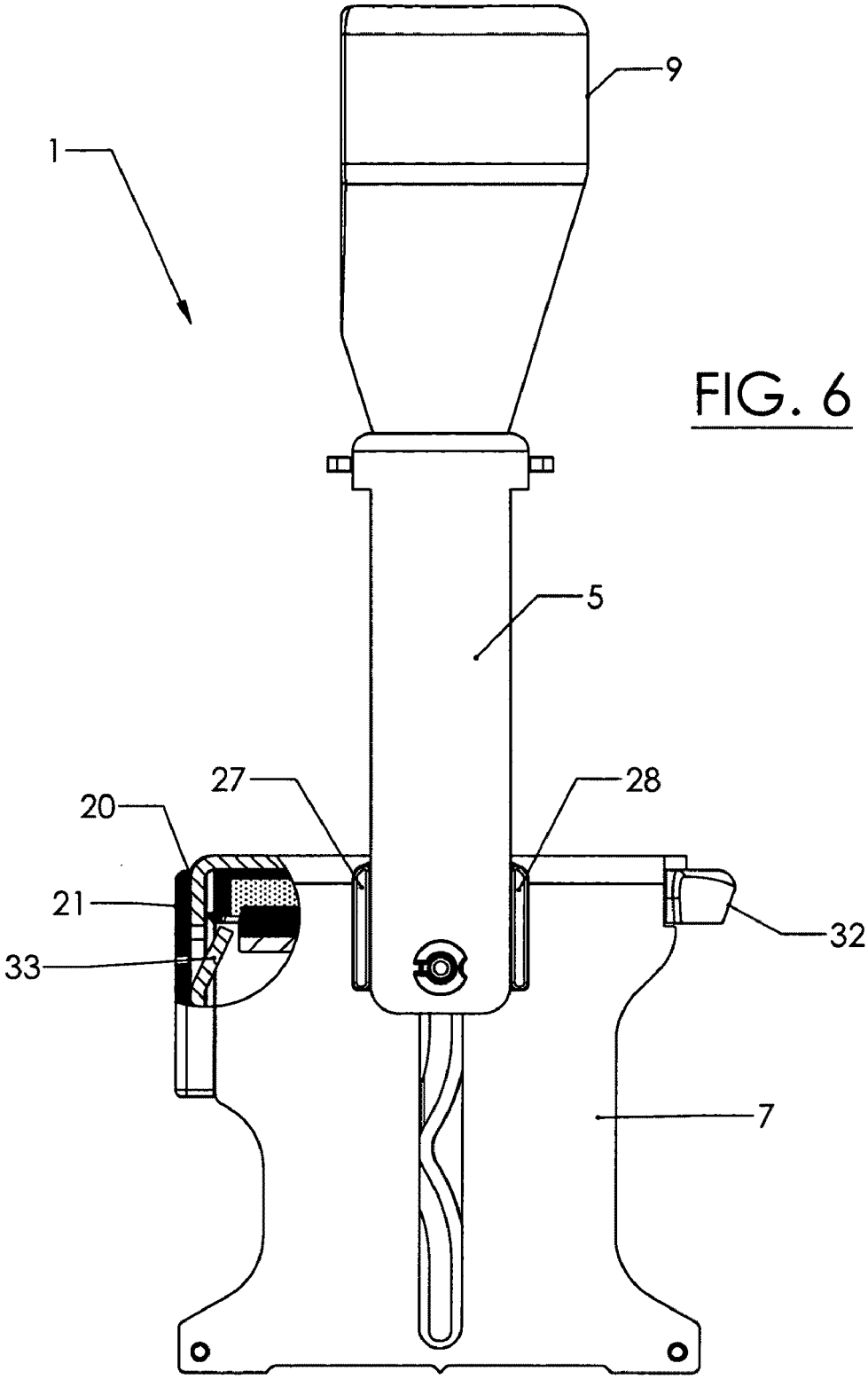
FIG. 6 shows a partially broken-away side view of the hand stamp according to FIGS. 1 to 5 for illustrating a support projection in the region of the front side of the frame for supporting an ink pad holder.

From FIG. 3 and also from FIG. 6 it is, furthermore, apparent that the front-side transverse wall 20, which extends between the side walls 6, 7 of the frame 2, is cut out or punched out in certain areas thereof, so that bent-out lugs are formed as further support projections 33 for one of the longitudinal sides of the ink pad holder 13.

Figure 4:
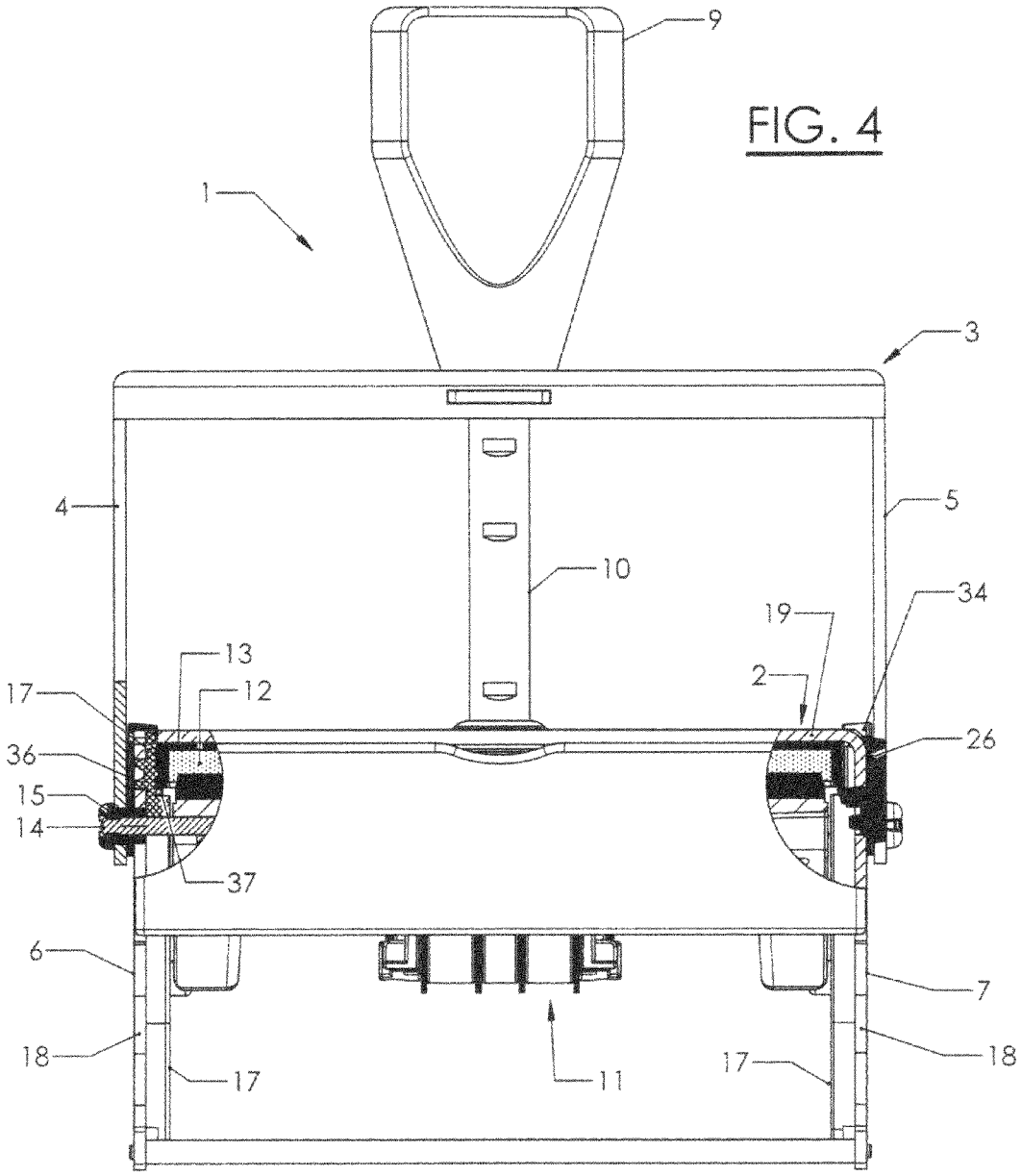
FIGS. 4 and 5 are front views of the hand stamp according to FIGS. 1 to 3 in the resting or inoperative position (FIG. 4) and in the stamping or imprinting position (FIG. 5), wherein corner regions of the stamp frame have been broken away so as to illustrate details with regard to the coupling of a turning axle with the actuating bow, the hinging of a pivotable link which controls turning of the type unit of the hand stamp, as well as in particular the latching of a platelet-shaped guiding member.
Figure 7:
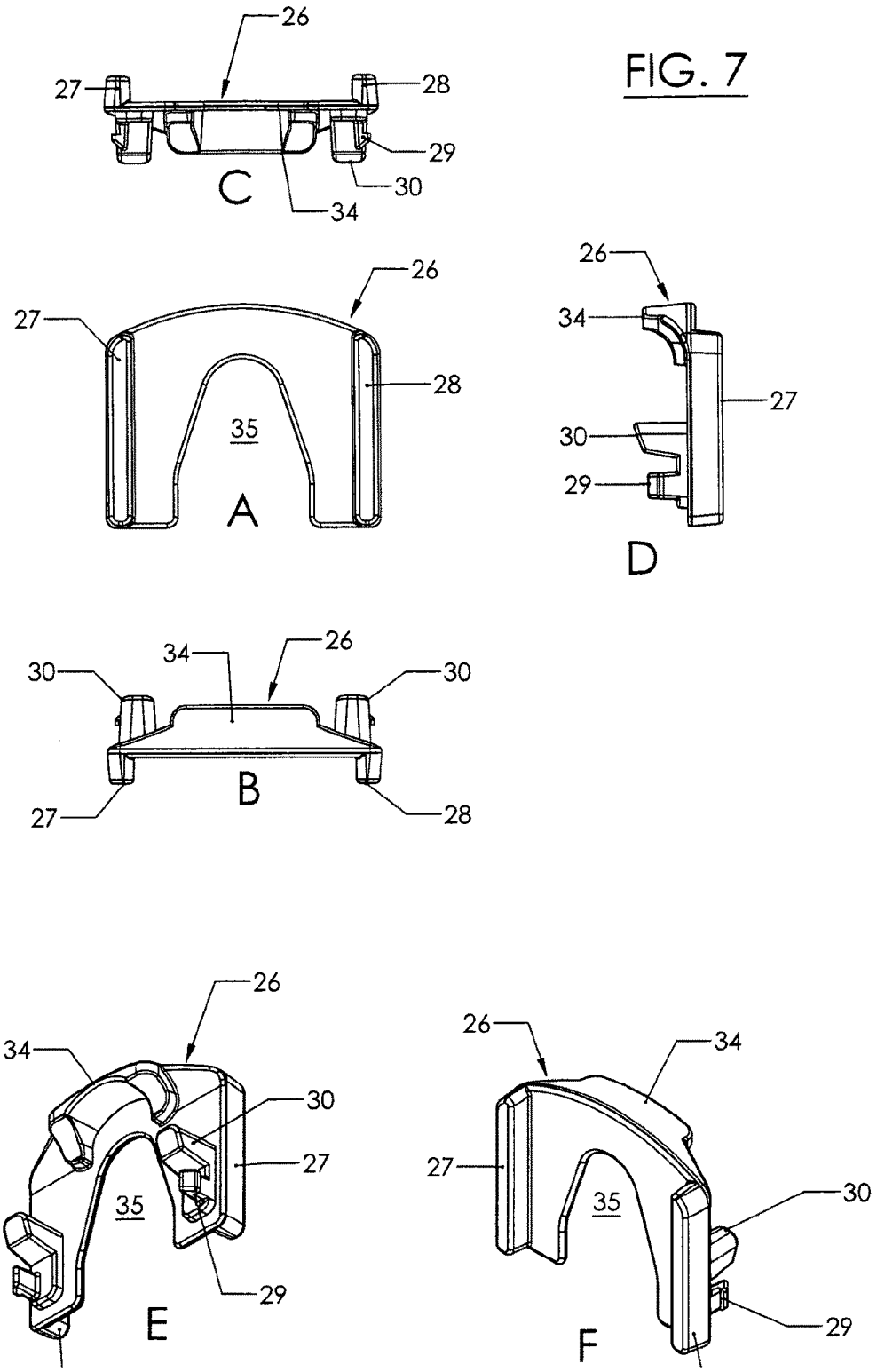
FIG. 7, in partial figures A to F, shows a platelet-shaped guiding member as provided in the present hand stamp for guiding a leg of the actuating bow on the stamp housing or frame, in a front view (A), a top view (B), a bottom view (C), a side view (D), an axonometric view of the inner side (E), and an axonometric view of the outer side (F)

From FIG. 7, in partial figures B and C to F, it is, furthermore, apparent that the platelet-shaped guide body 26 on its upper side, on the side facing away from the guide webs 27, 28 for the bow legs 4, 5, has a roof projection 34 by which it abuts, in the mounted position, on the transition from the respective side wall, e.g. 7, to the upper cover wall 19, cf. e.g. also FIG. 4. By this roof projection 34, an additional positive stabilisation of the guide body 26 in its position mounted to the frame 2 will be achieved.

In a modification of the embodiment according to FIGS. 1 to 7, the latch projections 29 and the support projections 30 can also be formed by one and the same projections 29-30, i.e. the support projections 30, on their outer or lower sides, may, for instance, be provided with corresponding hooks for latching engagement in corresponding openings provided in the frame side walls 6 and 7, respectively. In this way, the production will be facilitated to the extent that in the respective side wall only a total of two openings need to be provided for two combined projections 29-30, instead of a total of four openings for two latch projections 29 and two support projections 30. On the other hand, the embodiment illustrated, however, offers the advantage of a particularly stable positional fixation of the respective guide body 26 on the frame 2.

Finally, it can be seen from FIG. 7, from the partial figures A, E and F, that the platelet-shaped guide body 26 is provided with a downwardly open recess 35. In this manner, space will be provided for the ends of the turning axle 14 in the upper position of the type unit 11 when the guide body 26 is mounted on the frame 2, cf. e.g., the illustration on the left-hand side in FIG. 4. There, it can be seen that the control link element 17 in its upper region, where it is pivotably mounted with a support projection 36 in the respective side wall, e.g. 6, may be flattened or stepped on its inner side, as shown at 37, so as to better provide space for the ink pad holder 13.

Figure 5:
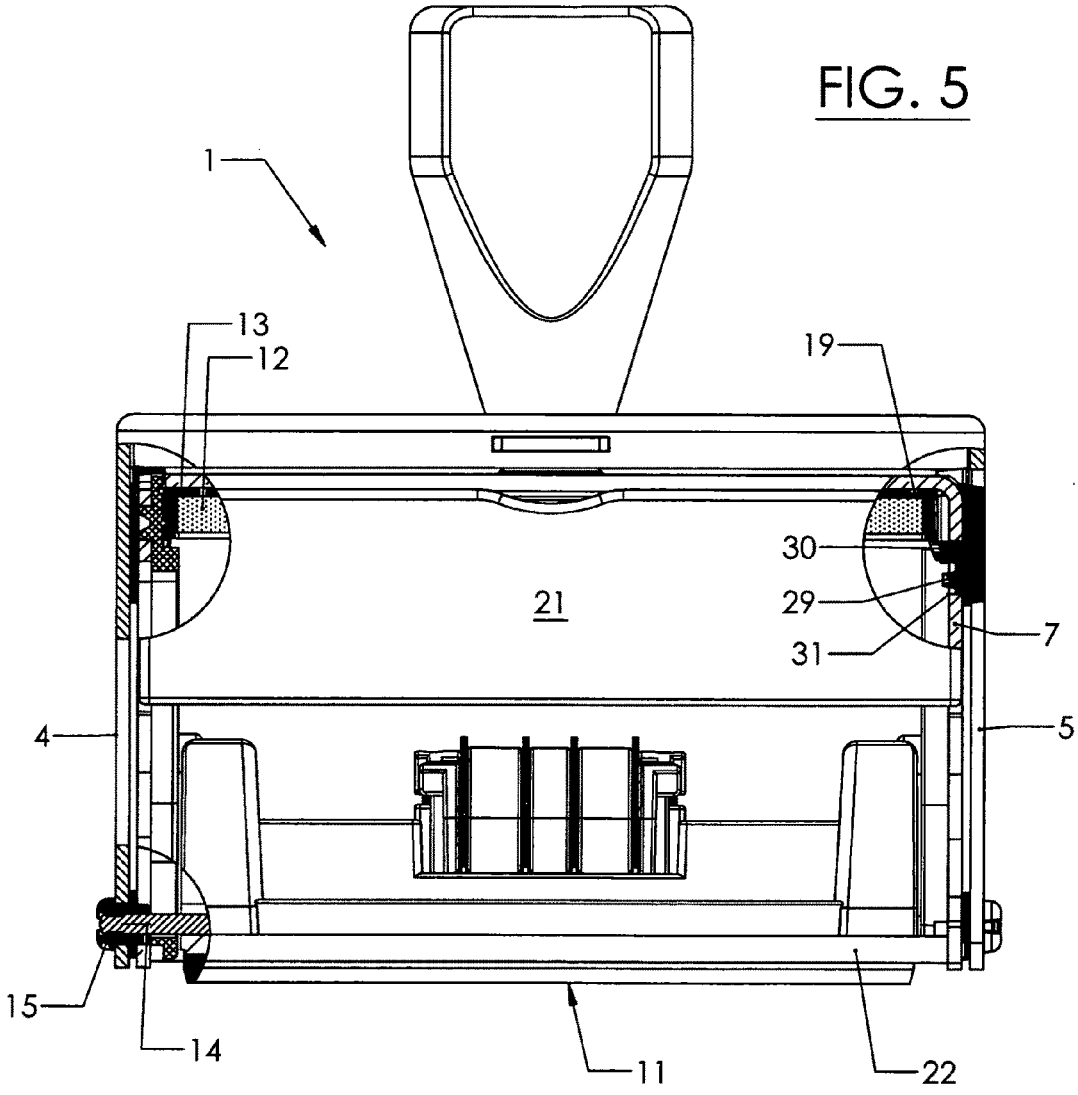

In the embodiment according to FIGS. 1 to 7, the respective actuating bow leg 4, or 5, respectively, slides on the platelet-shaped guide body 26 with planar contact, cf. in particular the sectional representations in FIGS. 4 and 5, left side, wherein the platelet part proper of the guide body 26 also acts as a spacer element between the respective side walls 6 and 7, respectively, and the associated legs 4 and 5, respectively. By this, sliding of metal on metal will be avoided, and the guiding bodies 26 will provide an advantageous, smooth-running slide-guide for the bow legs 4, 5.

Figure 8:
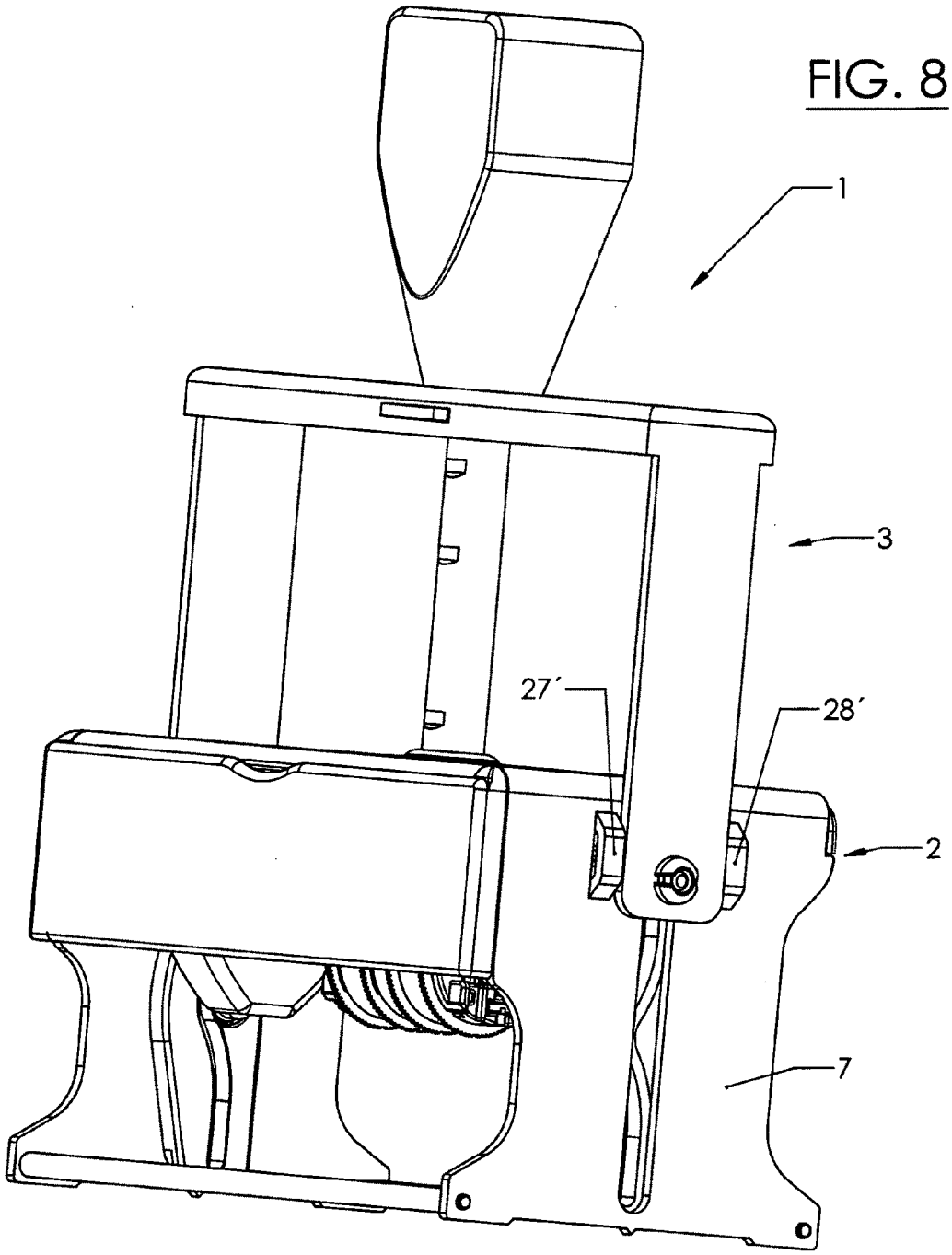
FIG. 8, in an axonometric view similar to FIG. 1, shows an alternative embodiment of a hand stamp having modified guide webs for the legs of the actuating bow.

In FIG. 8, a guide for the bow legs 4, 5 which is simplified as compared to FIGS. 1 to 7 is provided in the form of a mere lateral guide by means of separate guide webs 27', 28' which are each, for instance, made of plastics (e.g. POM, ABS or PE) and fixed by means of latch projections as described above (cf. the latch projections 29) to the associated side wall, e.g. 7, of the frame 2. Here, too, the guide webs 27', 28' may on their inner sides be further provided with separate support projections corresponding to the support projections 30 according to FIG. 7, to thereby obtain a retention means and an insertion guide for the ink pad holder 13 (not visible in FIG. 8, yet cf. FIG. 3).

With regard to the design of the frame 2 and of the bow 3, the hand stamp 1 according to FIG. 8 otherwise preferably corresponds to that according to FIGS. 1 to 7, so that further description is omitted.

Even though in the foregoing description the invention has been explained in more detail by way of preferred exemplary embodiments, changes and modifications are possible within the scope of the invention. Thus, e.g., also type units other than a type unit 11 as shown may be used, e.g. such one having a simple printing plate with a fixed text instead of a type unit having adjustable type belts, optionally in combination with an unchangeable text adjacent the adjustable types. The support projection 33 bent outwards from the front-side transverse wall 20 may also be wider than that shown in FIG. 3, wherein, e.g., an extension over half of the length of the transverse wall 20 would very well be conceivable.

What is claimed is:

1. A self-inking hand stamp comprising a frame made of metal and including two frame side walls, and an upper cover wall, said upper cover wall interconnecting said two frame side walls, an actuating bow made of metal, which in use is downwardly movable relative to said frame against a spring force, said actuating bow having an upper web and two bow legs protruding from said upper web and displaceable along said frame side walls, a type unit arranged to be upwardly and downwardly displaceable and turnable within said frame, said type unit being coupled with said bow legs of said actuating bow, and guide members comprising two parallel guide webs laterally abutting on the respective one of said bow legs, which is rectangular in elevation and narrower as compared to each one of said frame side walls, said guide members including latch projections engaged in openings of the side walls of the frame, thereby the guide members being attached to the outer sides of the respective frame side walls in the upper region thereof.

2. The hand stamp set forth in claim 1, wherein said guide members comprise a generally platelet-shaped guide body latched to the respective one of said frame side walls, and wherein said guide webs are formed on a side of said platelet-shaped guide body.

3. The hand stamp set forth in claim 2, further comprising an upper transition region extending from each of said frame side walls to said upper cover wall of said frame, and wherein said guide body comprises an upper, flange-like roof projection protruding from the side opposite the side of said guide webs and abutting on said upper transition region.

4. The hand stamp set forth in claim 2, wherein said latch projections are provided on said guide body on its side facing away from said guide webs, and associated latch openings provided in each of said frame side walls, said guide body being fixed in said associated latch openings by the aid of said latch projections by snapping engagement.

5. The hand stamp set forth in claim 2, wherein said guide body, on its side facing away from said guide webs, comprises support projections for an ink pad holder inserted or insertable in the upper region of said frame, said support projections projecting through openings provided in said frame side walls.

6. The hand stamp set forth in claim 5, wherein said support projections are provided above said latch projections.

7. The hand stamp set forth in claim 5, wherein said latch projections simultaneously form said support projections.

8. The hand stamp set forth in claim 2, wherein said type unit comprises a turn axle or axle stub, and wherein said platelet-shaped guide body comprises a central, downwardly open recess for an end of said turn axle or axle stub of said type unit to pass therethrough.

9. The hand stamp set forth in claim 1, wherein said guide webs are made of plastics.

10. The hand stamp set forth in claim 9, wherein said plastics is selected from the group consisting of POM, ABS and PE.

* * * * *